United States Patent [19]

Seilly et al.

[11] 4,375,793

[45] Mar. 8, 1983

[54] ACTUATOR MECHANISM

[75] Inventors: Alec H. Seilly, North Wembley; Thomas Laity, London, both of England

[73] Assignee: Lucas Industries Limited, Birmingham, England

[21] Appl. No.: 154,956

[22] Filed: May 30, 1980

[30] Foreign Application Priority Data

Jul. 6, 1979 [GB] United Kingdom ..... 7923686

[51] Int. Cl.[3] ..... F01L 9/04

[52] U.S. Cl. ..... 123/90.11; 123/90.41

[58] Field of Search ..... 123/90.11, 90.39, 90.41, 123/90.45, 90.46, 90.47; 74/519, 559

[56] References Cited

U.S. PATENT DOCUMENTS

| | | | |
|---|---|---|---|
| 1,441,302 | 1/1923 | Schneider | 123/90.39 |
| 1,701,563 | 2/1929 | Griswold | 123/90.39 |
| 3,626,469 | 12/1971 | Ashley | 123/90.41 |
| 4,269,388 | 5/1981 | Seilly et al. | 123/90.11 |

FOREIGN PATENT DOCUMENTS

| | | | |
|---|---|---|---|
| 2315723 | 10/1974 | Fed. Rep. of Germany | 123/90.39 |

*Primary Examiner*—Craig R. Feinberg
*Assistant Examiner*—W. R. Wolfe

[57] ABSTRACT

An actuator mechanism for imparting movement to a movable member includes a first lever pivoted about a pivot axis and engageable by the output member of an electromagnetic device after an initial movement thereof. A second lever is provided which is pivotable about a fulcrum and which is engaged with said output member so as to move about said fulcrum during the initial movement of the output member. Means is provided on the second lever which engages the first lever between the movable member and the point of engagement of the output member whereby the lever ratio between the output member and the movable member is high after said initial movement has taken place but is low while said initial movement is taking place.

5 Claims, 4 Drawing Figures

ACTUATOR MECHANISM

This invention relates to an actuator mechanism for imparting movement to a movable member and of the kind comprising an electro-magnetic device including an output member and a lever mechanism acting in use, between the output member and the movable member.

Such a mechanism is known for operating a poppet valve of an internal combustion engine, see for example the Specification of French Patent Application Ser. No. 7800767. The known mechanism includes a lever pivotally mounted at one end and engageable with the stem of the associated valve at its other end. The output member of the electro-magnetic device is engageable with the lever at a position adjacent the pivot axis thereof. The lever ratio is such that for a small movement of the output member a large movement of the valve is obtained. The typical lever ratio is in the order of 8:1.

An engine exhaust valve is required to open when there is a considerable pressure within the engine cylinder. A typical value of pressure is 350 $kN/m^2$ and this pressure exerts a force on the head of the valve which acts to maintain the valve in the closed position. This force is also supplemented by the force exerted by the valve spring. Thus in order to open the valve the actuator mechanism must be capable of overcoming this force.

In order to increase the force available for a given size of electro-magnetic device the lever ratio must be reduced but this means that to provide for the desired valve travel, the stroke of the device must be increased. With most forms of electro-magnetic device if the stroke is increased then for a given size of the device, the initial force available decreases and as a result no advantage is obtained and it is necessary to provide a more powerful electro-magnetic device.

The object of the invention is to provide an actuator mechanism in a simple and convenient form which in use, provides a low lever ratio to effect initial movement of the movable member and then an increased lever ratio to complete the movement of the movable member.

According to the invention an actuator mechanism of the kind specified comprises a first lever pivotally mounted at one end and arranged in use to couple with the movable member at or adjacent its other end, the output member after an initial movement being operatively connected to said first lever at a position adjacent the pivot axis of the first lever, a second lever, means defining a fulcrum for the second lever adjacent one end thereof, the opposite end of said second lever being operatively connected to the output member during said initial movement thereof and means located intermediate the ends of the second lever and between said position and the other end of the first lever, for transmitting movement between the levers during said initial movement of the output member.

One example of an actuator mechanism in accordance with the invention will now be described with reference to the accompanying drawings in which.

Figure 1:
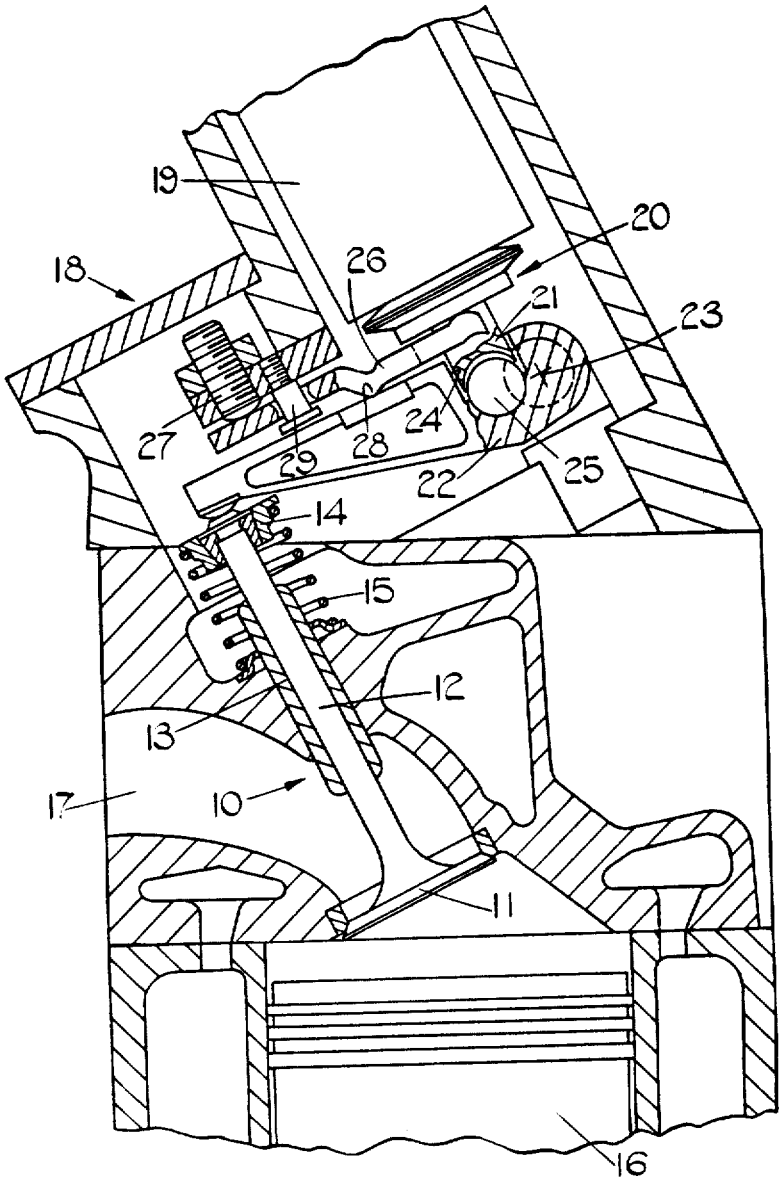
FIG. 1 is a sectional side elevation of the actuator mechanism and shown associated with an engine exhaust valve.

Referring to FIG. 1 of the drawings an engine poppet valve is indicated at 10 having a head 11 and a stem 12. The stem extends through a valve guide 13 and mounts an abutment 14 for a coiled compression spring 15 which acts to maintain the valve in the closed position. The piston of the associated cylinder is seen at 16 and the valve 10 controls the flow of exhaust gas from the combustion chamber to an exhaust outlet 17. In operation, the exhaust valve is required to open whilst the associated cylinder contains gas under pressure and therefore the force applied to the valve must overcome the force developed on the head of the valve by the gas under pressure in the engine cylinder and also the force exerted by the coiled compression spring 15. Once the valve has been opened then the valve head becomes pressure balanced but in any event it is likely that the pressure within the engine cylinder will fall very quickly so that only the force exerted by the spring 15 needs to be overcome to move the valve to its fully open position.

An actuator mechanism generally indicated at 18 is provided to move the valve to the open position from the closed position in which it is shown. The actuator mechanism includes an electro-magnetic device 19 which will be described in detail with reference to FIG. 4, later in this specification. Sufficient to say that the electro-magnetic device includes an output member 20 which has a centrally disposed stem portion 21 the outer end of which is provided with a spherical recess.

The actuator mechanism includes a first lever 22 which is pivotally mounted at one end about a pivot axis 23. At its other end the lever is shaped to co-operate with the end of the valve stem 12. The lever 22 is provided with a recess 24 into which extends the stem portion 21 and a ball 25 is disposed in the base portion of the recess for engagement with the spherical surface defined in the end of the stem portion 21. In the closed position of the valve and in the de-energised condition of the electro-magnetic device 19 as shown in FIG. 1, a clearance exists between the spherical surface and the ball 25.

The actuator mechanism includes a further lever 26 one end of which is bifurcated and the bifurcated ends are provided with projections engageable with the output member 20. Adjacent its other end the lever 26 engages an adjustable peg 27 which constitutes a fulcrum for the lever 26. Moreover, intermediate its ends the lever 26 is provided with a projection 28 for engagement with a pressure pad which is carried by the lever 22 at a position between the end of the lever which engages the valve stem and the axis of movement of the output member 20. Finally a peg 29 extends with clearance through an aperture in the lever 26 and it is provided with a head which in the position of the part shown in FIG. 1, is spaced from the lever 26 on the opposite side thereof to the adjustable peg 27.

Figure 4:
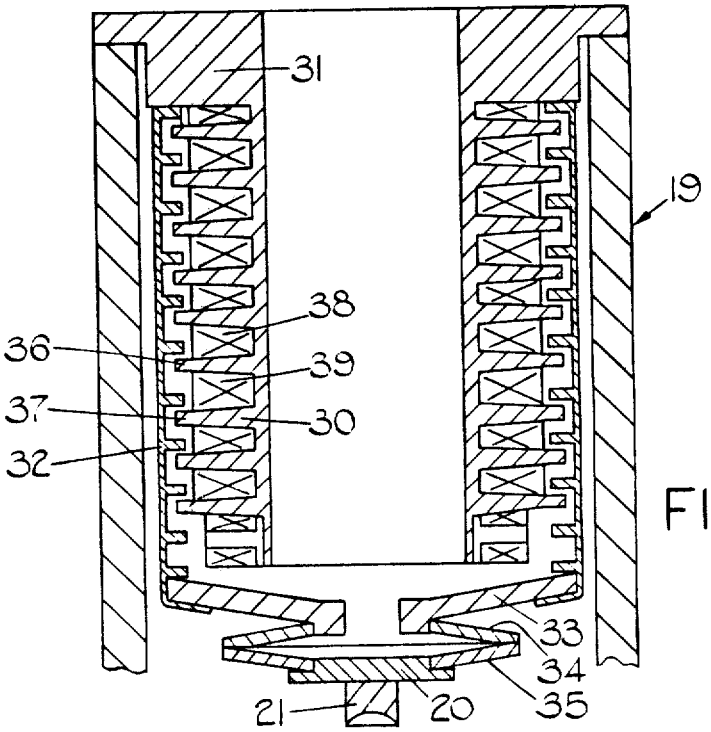
FIG. 4 is a sectional side elevation of part of the mechanism seen in FIG. 1.

Turning now to FIG. 4, the electro-magnetic device comprises an inner annular member 30 which is mounted on a support structure 31 and a movable outer annular member 32. The outer annular member extends beyond the inner member and carries an end closure 33. The end closure 33 mounts a dished washer 34 and a further dished washer 35 is mounted on the output member 20. The dished washers are positioned so that they can act as a spring between the member 33 and the output member 20. Means not shown may be provided to maintain the parts in assembled relationship without impairing their operation as will be described. The inner annular member 30 is formed from magnetisable material and is provided on its outer peripheral surface, with a two start helical thread form which defines two helical ribs 36, 37. The two ribs define a pair of helical grooves in which are located windings 38, 39 and the windings are conveniently formed by winding wire along one groove and returning the wire along the other groove. Thus when electric current is passed through the windings, the ribs will assume opposite magnetic polarity.

The outer member 32 which is formed from magnetisable material, constitutes an armature and is provided on its internal peripheral surface, with a pair of helical projections which extend into the grooves respectively. In the rest position as shown in FIG. 4, the projections are off set within the grooves so that when electric current is supplied through the windings, the outer member will move downwardly as shown in FIG. 4, to reduce the reluctance of the air gaps existing between the ribs 37, 36 and the projections.

The operation of the device will now be described starting from the condition shown in FIG. 1. When electric current is supplied to the windings the outer member or armature 32 will move downwardly as shown in FIG. 4 and during the initial portion of the downward movement there may be compression of the washers 34, 35. A force however will be applied to one end of the lever 26 and since the other end of the lever is in engagement with the peg 27, the lever will pivot about the fulcrum defined by the peg 27 and will impart pivotal movement to the lever 22. The lever ratio in this condition is approximately 1:1. As a result a considerable force is applied to the stem of the valve which force is arranged to be sufficient to open the valve against the combined action of the spring 15 and the force exerted on the head of the valve by the gas under pressure within the engine cylinder. The parts move to the position shown in FIG. 2 and in this position the clearance between the recess in the stem portion 21 and the ball 25 has just been taken up. From this position further movement of the armature 19 will transmit movement to the lever 22 by way of the stem portion 21 and the ball 25. The lever ratio is therefore substantially increased and for a given movement of the armature the movement of the valve is substantially larger depending on the lever ratio. A typical lever ratio will be 8:1.

During the movement of the lever 22 directly by the stem portion, the lever 26 is limited by the action of the head on the peg 29. This is shown in FIG. 3 and it will also be seen that the lever has moved out of engagement with the output member 20 and also with the lever 22.

The washers 34 and 35 serve as an energy storage arrangement and permit the armature 32 to move quickly to reduce the $I^2R$ losses in the winding. The force is insufficient to accelerate the valve and its associated masses at the same rate and the energy stored in the washers is transmitted more slowly to the valve to effect its movement.

Figure 2:
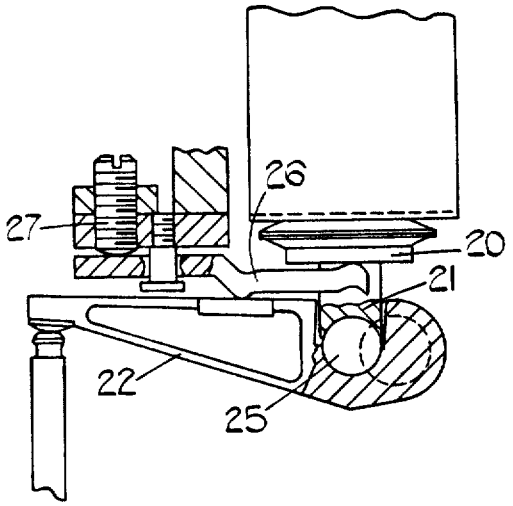
FIGS. 2 and 3 are views showing the parts of the mechanism seen in FIG. 1 at different positions.
Figure 3:
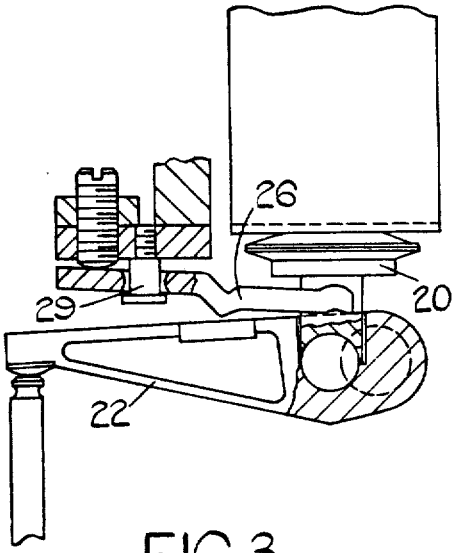

As shown in FIGS. 1-3 the projection 28 defined on the lever 26 has a small radius with the result that during movement of the lever about the fulcrum defined by the peg the point of contact between the projection 28 and the lever 22 will remain substantially fixed. As a result the lever ratio between the output member 20 and the lever 22 whilst the latter is being moved by the lever 26 will remain substantially constant. If however the radius of the surface of the abutment is increased the point of contact between the two levers will as the levers pivot, move towards the pivot axis 23. Thus the lever ratio will gradually increase.

We claim:

1. An actuator mechanism for imparting movement to a movable member and comprising an electromagnetic device including an output member and a lever mechanism acting, in use, between the output member and the movable member, said lever mechanism comprising a first lever pivotally mounted at one end and arranged, in use, to couple with the movable member at its other end, the output member after an initial movement being operatively connected to said first lever at a position adjacent the pivot axis of the first lever, a second lever, means defining a fulcrum for the second lever adjacent one end thereof, the opposite end of said second lever having a bifurcated end portion for engagement with said output member during the initial movement thereof, and means located intermediate the ends of the second lever and between said position and the other end of the first lever for transmitting movement between the levers during said initial movement of the output member.

2. A mechanism according to claim 1 in which said second lever is provided with an aperture which receives a peg having a head which acts to limit the movement of the second lever about said fulcrum.

3. A mechanism according to claim 2 in which said fulcrum is defined by an ajustable peg engageable with said second lever.

4. A mechanism according to claim 2 in which said means comprises a projection on said second lever and engageable with said first lever.

5. A mechanism according to claim 4 in which the face of said abutment presented to said first lever is a curved surface.

* * * * *